United States Patent [19]

Lowthian

[11] Patent Number: 4,819,288

[45] Date of Patent: Apr. 11, 1989

[54] CUSHIONS

[75] Inventor: Peter T. Lowthian, Watford, England

[73] Assignee: National Research Development Corporation, London, England

[21] Appl. No.: 81,225

[22] Filed: Aug. 4, 1987

[30] Foreign Application Priority Data

Aug. 6, 1986 [GB] United Kingdom ..... 8619186

[51] Int. Cl.[4] ..... A47C 27/15

[52] U.S. Cl. ..... 5/481; 297/DIG. 1; 297/458; 5/464

[58] Field of Search ..... 5/481, DIG. 2, 459, 5/448, 464; 297/DIG. 1, 452, 458, 459, 457

[56] References Cited

U.S. PATENT DOCUMENTS

| | | | |
|---|---|---|---|
| 2,800,165 | 7/1957 | Talalay et al. | 297/458 |
| 2,878,153 | 3/1959 | Hacklander | 5/DIG. 2 |
| 2,888,976 | 6/1959 | Hart | 297/459 |
| 3,000,020 | 9/1961 | Lombard et al. | 297/DIG. 1 |
| 3,118,153 | 1/1964 | Hood | 5/DIG. 2 |
| 3,751,111 | 8/1973 | Taylor et al. | 297/DIG. 1 |
| 3,833,260 | 9/1974 | Harder | 297/DIG. 1 |
| 3,846,857 | 11/1974 | Weinstock | 5/464 |
| 3,987,507 | 10/1976 | Hall | 5/DIG. 2 |
| 4,571,763 | 2/1986 | Suzuyama | 297/DIG. 1 |
| 4,572,577 | 2/1986 | LaRue | 297/DIG. 4 |
| 4,580,301 | 4/1986 | Ludman et al. | 5/481 |
| 4,646,374 | 3/1987 | Shafer | 297/DIG. 4 |
| 4,670,925 | 6/1987 | Carussi | 5/481 |
| 4,682,818 | 7/1987 | Morell | 5/DIG. 2 |

FOREIGN PATENT DOCUMENTS

| | | | |
|---|---|---|---|
| 93065 | 11/1983 | European Pat. Off. | 297/DIG. 1 |
| 2556025 | 6/1977 | Fed. Rep. of Germany | 297/458 |
| 3018935 | 11/1981 | Fed. Rep. of Germany | 297/DIG. 2 |
| 952001 | 3/1964 | United Kingdom | 297/DIG. 1 |
| 1263418 | 2/1972 | United Kingdom | 5/464 |

*Primary Examiner*—Alexander Grosz
*Assistant Examiner*—Eric K. Nicholson
*Attorney, Agent, or Firm*—Cushman, Darby & Cushman

[57] ABSTRACT

A foamed elastomeric seat cushion (10), especially for a wheelchair, has an overall upper part (20) supported by a lower part (30), the lower part rear portion (40) being formed by two like transversely spaced blocks (**40*a*,40*b*), each block being of sandwich construction with front-to-rear upright layers, and higher density in an intermediate layer than the associated outer layers. These blocks extend forwardly to about the cushion middle, they extend similarly upwardly, they have about equal width with their mutual spacing, and they have layers of about equal thickness. The lower part front portion (50) can be formed with similar blocks (50*a*,50*b*), but with transversely directed layers and a smaller block spacing. The upper part can also be of multiple layers (21,22,23**) with an increase in density for downwardly successive layers up to no more than the minimum density in the lower part.

9 Claims, 3 Drawing Sheets

CUSHIONS

Figure 1:
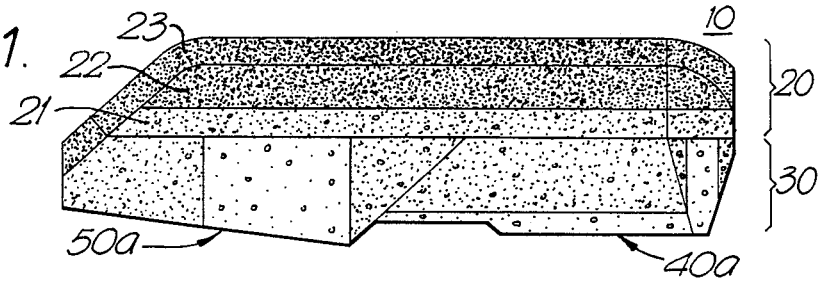

This invention concerns cushions and more particularly seat cushions for chairs.

The invention has in fact been developed primarily for wheelchair seats and it is both convenient and appropriate to describe the invention further in this context. However, it will be appreciated that the invention can find application for other chair seats.

It is clearly desirable that seat cushions for wheelchairs be of a form which distributes weight well to enhance comfort and to reduce the incidence of pressure sores. Currently, this objective is often pursued by the use of what can be termed a sculptured cushion form in which the upper surface is profiled to receive the user's thighs and buttocks. However, if this approach is to be successful it is accompanied by a requirement for a large range of different profiles to be made available by way of ready-made cushions, or a requirement for custom-forming of cushions to suit individual users and, in either event, this is costly. Also many sculptured cushions for wheelchairs have a relieved upper surface configuration with cut-outs and this is less readily acceptable to a user because of the accurate positioning required and by virtue of its contrast to an ordinary smooth-topped cushion.

An object of the present invention is to avoid this last situation and, to this end, there is provided a chair seat cushion made of foamed elastomeric material having an upper part extending wholly thereover and supported by a lower part, at least the rear portion of said lower part being formed by two like transversely spaced blocks, each said block being of a multi-layered construction including at least two adjoining upright layers extending in the front-to-rear direction of the cushion, and one of said two layers defining the transversely innermost surface of the respective block and being of lesser density than the other of such layers.

Preferably the transversely innermost upright layer of each block is of an intermediate density for the overall cushion with the adjoining layer being of highest density. As so far developed for trial the blocks are essentially of a three-layer sandwich construction with the middle and outer layers respectively of relatively high and intermediate densities, but variation of such construction is contemplated as will be appreciated hereinafter.

The front portion of the lower part of the cushion is also preferably formed by two like transversely spaced blocks, but with the inter-block spacing being less than that for the rear portion.

Also, the front portion is preferably of a similar layered construction to that of the rear blocks, but with the layers extending transversely of the cushion and lesser density material in the rearmost layer.

Preferably the upper part is also composed of multiple layers each extending over the cushion and with a progressive increase in density for downwardly successive layers up to a maximum in the lowest layer, which maximum does not exceed that of the transversely innermost layers in the rear blocks.

The cushion has a normal appearance by virtue of its overall upper part, and, in use, this part molds smoothly to a patients shape by way of a variable collapse dependent upon the patients weight and weight distribution when seated. More emaciated patients have more prominent ischial bones and compacted distribution than patients with a normal or greater depth of subcutaneous tissue, and the former accordingly cause a deeper collapse of the cushion. However, the structure of the present cushion has, by virtue of its layered blocks, its greater supporting capability located outwardly of the area of deepest collapse and so the load/pressure distribution in terms of reaction on the patient is less compacted for a more emaciated patient than would otherwise be the case with a cushion having relatively uniform support properties. Thus an emaciated patient has more of his weight supported by his preischial (distal to the ischia) and trochanteric shelf areas by the proposed cushion. Other patients who have better natural upholstery will compact the cushion to a lesser depth and be supported over a wider area.

Given this result, the proposed cushion can be made in just a few versions to accommodate a wide variety of patients.

The layered blocks are also beneficial in their use of material of different densities in that the high density layers increase the fatigue life of the cushion in use. Changes which occur in the support given by the cushion over a period of time are accordingly slower than may otherwise be the case and a patient's tissue can better accommodate to the changes.

Figure 2:
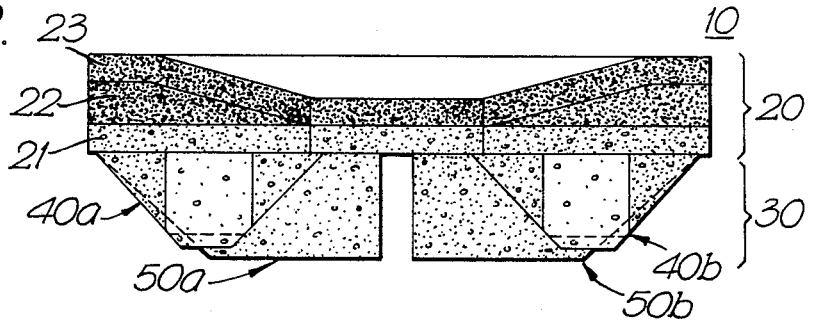
Figure 3:
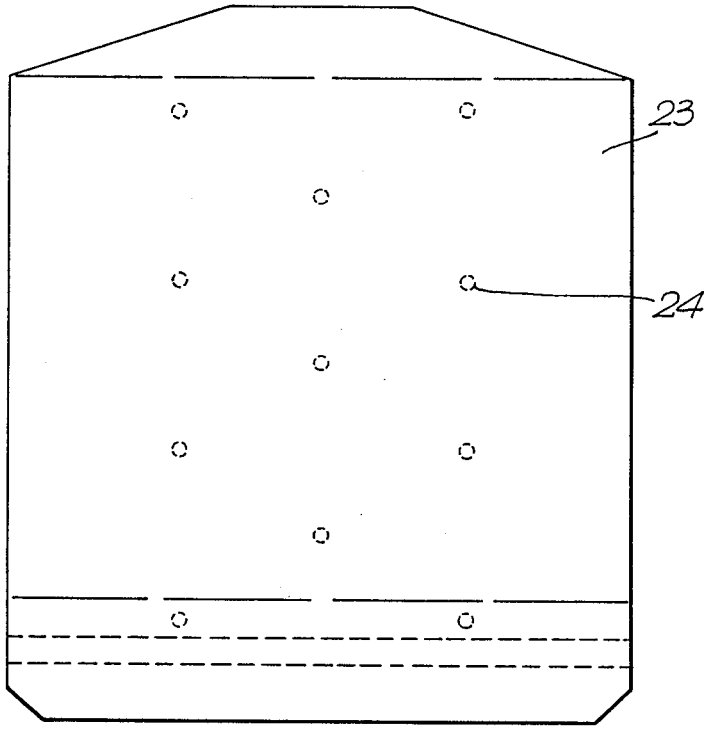

In order that the invention may be more fully understood two embodiments thereof are illustrated, by way of example, in the accompanying drawings, in which:

FIGS. 1, 2 and 3 respectively illustrate a first embodiment in side, rear and plan views.

Figure 4:
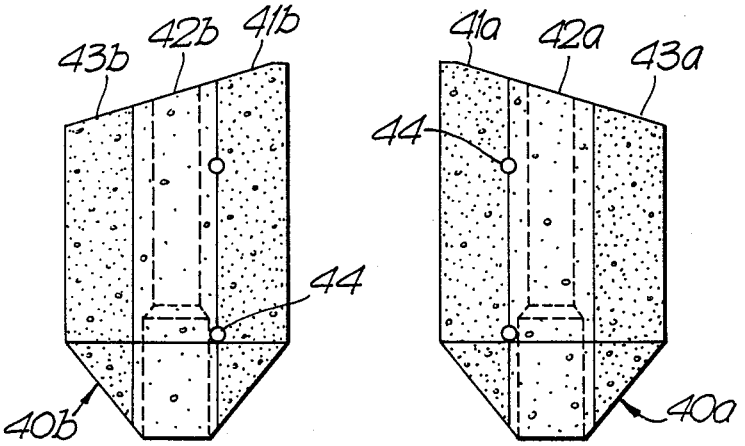
Figure 5:
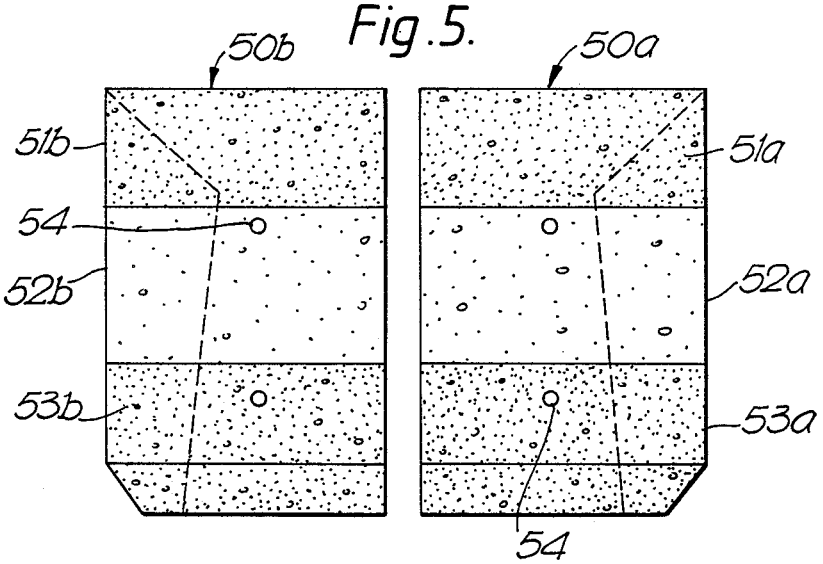
Figure 6:
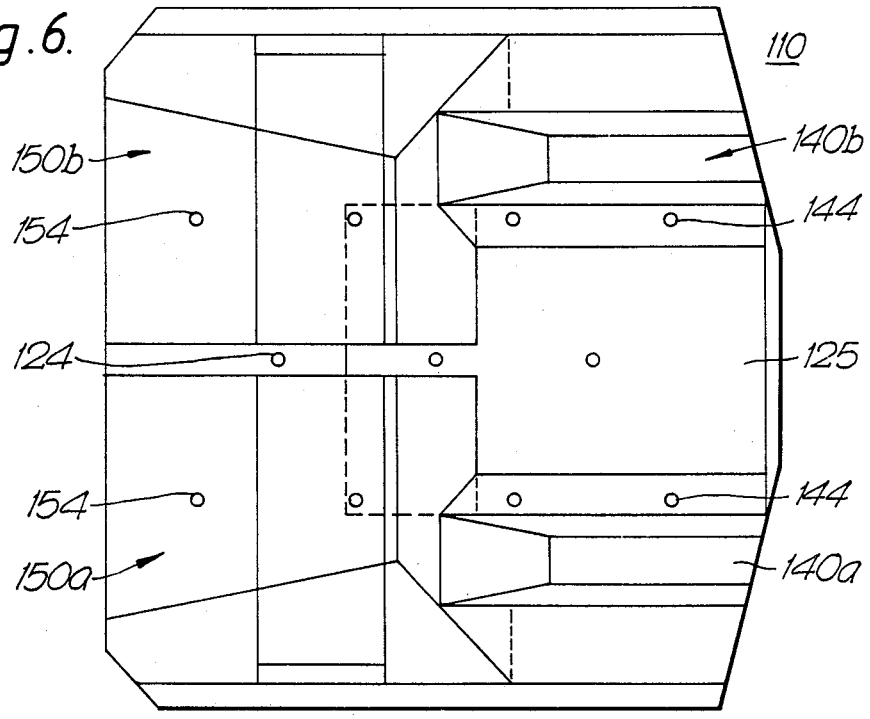
Figure 7:
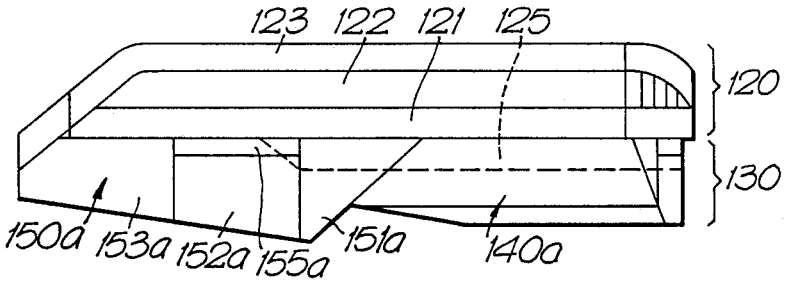
Figure 8:
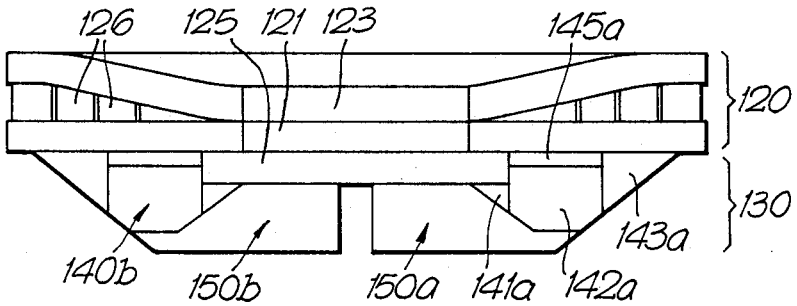

FIGS. 4 and 5 respectively illustrate the rear and front portions of the lower part of such embodiment in plan view, and FIGS. 6,7 and 8 respectively illustrate a second embodiment in underneath plan, side and rear views.

In FIGS. 1 to 5 the first cushion embodiment is designated 10 as a whole and is made of foamed elastomeric material of open-cell form including upper and lower parts respectively denoted 20 and 30. The lower part comprises rear and front blocks 40 and 50 in mutually laterally spaced pairs. These blocks and their constituent layers are additionally designated with an 'a' or 'b' in the drawing to distinguish between the two sides of the cushion. However the individual blocks of each pair are identical apart from being of mutual mirror-image form and, for convenience, they are referred to in this description simply by way of their numerals.

The rear-blocks 40 are of a sandwich construction having three upright layers 41, 42, 43 extending in the front-to-rear direction, the intermediate layer 42 and outer layers 41 and 43 being respectively of the highest and next highest density of material in the cushion. Ventilation holes 44 are formed vertically through the blocks.

In overall shape each block 40 has its front end downwardly tapered from above and cut away to a small extent from below, its sides undercut in inclined manner to produce a symmetrical cross section over most of the length, and its rear end chamfered across the laterally outer 'corner'.

The front blocks 50 are of a sandwich construction of three upright layers 51, 52, 53 extending in a lateral direction. As with the rear blocks, the intermediate and outer layers are respectively of the highest and next highest density of material in the cushion. Ventilation holes 54 are formed vertically through the blocks.

In overall shape each block 50 has its front end upper edge chamfered, its underneath is cut away from the front towards the rear over a major proportion of its length in decreasing tapered manner and from there on in an increased manner to complement the front of the rear-blocks, and its laterally outer side is undercut in inclined manner over its length.

The upper part 20 of the cushion is composed of three generally horizontal layers 21, 22, 23. The lowest layer 21 is of uniform thickness to extend over the upper most surfaces of the blocks 40 and 50, except for a downward taper over its front edge to continue that of the front blocks. The intermediate layer 22 is of similar extent and downwardly tapered from above over its front and rear edges. Each of the layers 21 and 22 has vertical ventilation holes 24 registered with those in the blocks below, or the gaps therebetween. The uppermost layer 23 extends over the whole upper surface and has no ventilation holes other than the pores of the material.

The uppermost layer 23 is of the lowest density material in the cushion and is preferably flame-proofed, the middle layer 22 is of similar or slightly higher density and the lowest layer 21 is of similar density as that of the outer layers in the lower part blocks.

The general proportions of the configuration of the overall cushion are such that the cushion is approximately square in plan with a depth of about one quarter of the square dimension, this depth being made up approximately equally by the upper and lower parts. In the upper part the successive layers are of similar thickness. The lower part blocks extend about equally in the front-to-rear direction, with the rear blocks each extending over about a third or more of the cushion width and being spaced by about a third of such width or less, and with the front blocks extending over nearly half of the cushion width and having a lesser separation, suitably of about 20 mm, than the rear blocks. In the blocks themselves each sandwich body has layers of roughly equal maximum width, with the side undercutting of the rear blocks extending over the width of the outer layers, that of the front blocks conforming with this, and the front-to-rear taper under the front blocks extending over their two forward layers.

In a specific cushion as just described the highest density material is about 125 $Kg/M^3$, the next highest density is about 95 $Kg/M^3$, the lowest density for layer 23 is 32–36 $Kg/M^3$ and the similar density for layer 22 is 33–37 $Kg/M^3$, the various layers being bonded together with a flexible porous adhesive. The undersurface of the cushion has bonded to it, with the same adhesive, a flame-retardant fabric (not shown). In use, the cushion preferably has an inner cover of water vapour permeable material and an outer cover, held by a purse-string closure below the cushion, of flame-retardant towelling or other suitable fabric.

Turning to the second cushion embodiment: this represents a presently preferred form developed by modification of the first embodiment, with much of the geometry and construction being similar. In order to facilitate detailed comparison the same reference numerals as those in FIGS. 1 to 5 are used for corresponding elements in FIGS. 6 to 8 but with the addition of a one hundred digit in the latter case.

The most apparent differences in the second embodiment are found in the upper part 120 which has an additional lowermost layer 125 projecting into the lower part 130 and also has its second uppermost layer 122 composed of a multiplicity of strips 126 rather than one piece of material.

The additional layer 125 does not extend over substantially the whole area of the cushion in plan as do the associated layers 121 to 123, but only over about a quarter of this area. More particularly, the layer 125 extends over about one half each of the cushion width and front-to-rear depth, and it is respectively sited over the central and rear parts of such width and depth. The layer 125 accordingly bridges the lower part rear blocks 140 and also partially bridges the rear of the associated front blocks 150.

The strips 126 of layer 126 are suitably of approximately square dimensions in cross-section and they are successively spaced by a separation which is small compared to such dimensions, a suitable separation being about 3 mm.

The most evident difference in the lower part 130 of the second embodiment is that the rear and front blocks 140 and 150 are suitably recessed to accommodate the additional upper part layer 125. Similarly evident is that the middle layer of the sandwich of each block 140 and 150 has a major body denoted 142 or 152 to correspond with the first embodiment, but in this case is completed by a subsidiary top layer 145 or 155. Also, unlike the blocks 40, each block 140 is not cut away to a small extent from below over its front end but, instead, has this end undercut in slightly inclined manner.

As intimated above in reference to its construction, the choice of material densities for deployment in the various layers of the second embodiment suitably corresponds to those previously indicated for the first embodiment. However, one exception involves the lower layers of the upper part which preferably employ densities of the lowest order of density, but nevertheless with a progressive increase from top to bottom. Thus layers 123 and 122 are suitably in the ranges 32–36 and 33–37 $Kg/m^3$, while layer 121 is in the range 43–47 $Kg/M^3$ and layer 125 is in the same range or 48–51 $Kg/M^3$. Also, while the block middle layers each have a main body 142–152 of highest density, they are each completed by a subsidiary top layer 145 or 155 of next highest density as in the associated outer layers.

Other materials facets such as the application of flame retardant and water vapour permeable coverings are also similarly appropriate.

While the proposed cushion has been described with more particular reference to the illustrated embodiments, it will be appreciated from the more generalised nature of the introductory discussion that variation is possible.

For example while the blocks in the illustrated embodiments each involve a sandwich construction of three upright layers, on-going development contemplates the use of only two such layers with the intermediate and outermost layers of the three effectively integrated in a single layer of highest density. This can represent a simplification for the purposes of manufacture and also further enhance the fatigue life of the cushion without significant loss of other benefits.

Also, it is not essential that separate front blocks be used.

Again, the undercut nature of the embodiment at its sides is intended to suit use in a wheelchair seat of the common fabric sling form, without the need for a rigid board under the cushion. Clearly, such undercutting is not appropriate to other forms of seat. Indeed, for use in association with a more conventional relatively rigid and flat seat surface, the proposed cushion can be used in forms similar to those illustrated but with the lower part blocks reduced in thickness to provide a substantially planar lowermost surface thereover.

In another variation the cushion can be made adjustable by the provision of a strap or straps extending across the underside of the rear blocks 40 whereby these blocks can be pulled and held closer together. This adjustment facility allows differences in the anatomies of individual patients to be accommodated better with a limited range of cushion sizes, and particularly in respect of patients having relatively narrow pelvic bone structure.

I claim:

1. A chair seat cushion made of foamed elastomeric material and bounded by upper, lower, front, rear and two opposed side surfaces, said cushion comprising:

an upper part supported by a lower part;

said upper part extending continuously to border the whole of said upper surface;

said lower part having a rear portion formed by two like blocks mutually spaced transversely of said side surfaces;

each said block extending to border part of a respective different one of said side surfaces, each said block being of multi-layered construction including at least two layers extending generally parallel with said side surfaces, and with a first one of said two layers in each said block being the furthest layer of its block from the respective side surface and being of less density than the adjoining second one of such two layers.

2. A cushion according to claim 1 wherein each said block extends over approximately half of the cushion in the front-to-rear surface direction, and at least approximately a third of the cushion in the side-to-side surface direction.

3. A cushion according to claim 1 wherein the faces of said lower part bordering said side surfaces and the faces of said blocks bordering the inter-block space are each inclined to produce downwardly decreasing width for such part and blocks.

4. A cushion according to claim 1 wherein each said block includes three layers of approximately equal maximum thickness in the side-to-side surface direction, with the middle layer being of highest density and the outer layers being of like lesser density.

5. A cushion according to claim 1 wherein said rear portion blocks extend over approximately half of the thickness of the cushion in the upper-to-lower surface direction.

6. A cushion according to claim 1 wherein said lower part is formed over its front portion in a multi-layered construction similar to that for said rear blocks, but with its layers extending generally parallel to said front and rear surfaces.

7. A cushion according to claim 6 wherein said rear and front portion constructions employ like densities for their corresponding layers.

8. A cushion according to claim 6 wherein said front portion is formed by two like blocks mutually spaced in the direction between said side surfaces, the spacing between these blocks being less than that between said rear portion blocks.

9. A cushion according to claim 1 wherein said upper art is composed of multiple layers each extending generally parallel with said upper surface and with a progressive increase in density for downwardly successive ones of such layers, but with the maximum density of such upper part layers not exceeding the minimum density for said lower part block layers.

* * * * *